United States Patent [19]

Claridge

[11] Patent Number: 5,045,776

[45] Date of Patent: Sep. 3, 1991

[54] METERING APPARATUS

[75] Inventor: Ronald D. Claridge, Bedfordshire, Great Britain

[73] Assignee: ABB Kent plc, Luton, Great Britain

[21] Appl. No.: 382,645

[22] PCT Filed: Dec. 5, 1988

[86] PCT No.: PCT/GB88/01097

§ 371 Date: Dec. 14, 1989

§ 102(e) Date: Dec. 14, 1989

[87] PCT Pub. No.: WO89/05497

PCT Pub. Date: Jun. 15, 1989

[30] Foreign Application Priority Data

Dec. 4, 1987 [GB] United Kingdom ..... 8728359

[51] Int. Cl.[5] ..... G08S 23/00

[52] U.S. Cl. ..... 324/73.1; 324/158 R; 340/870.02

[58] Field of Search ..... 324/74, 157, 142, 73.1, 324/500, 537, 158 R; 340/870.02, 870.03, 825.21, 870.11, 870.13, 870.22, 870.27; 364/483; 346/14 MR

[56] References Cited

U.S. PATENT DOCUMENTS

| | | | |
|---|---|---|---|
| 3,641,537 | 2/1972 | Hoffman | 340/870.02 |
| 3,676,876 | 7/1972 | Dransfield et al. | 340/870.02 |
| 3,778,795 | 12/1973 | Campman et al. | 340/870.02 |
| 3,840,866 | 10/1974 | St. Clair et al. | 340/870.02 |
| 4,652,877 | 3/1987 | Gray | 340/870.03 |
| 4,688,038 | 8/1987 | Giammarese | 340/870.02 |
| 4,782,341 | 11/1988 | Gray | 340/870.02 |

*Primary Examiner*—Kenneth A. Wieder
*Assistant Examiner*—Vinh P. Nguyen
*Attorney, Agent, or Firm*—Wolf, Greenfield & Sacks

[57] ABSTRACT

Metering apparatus with a bank of number wheel indicators has wiper and position contacts to provide an electrical indication of the meter reading. The contacts are scanned in a measurement mode and, in an alternating test mode, test signals are imposed upon the position contacts and the output again scanned. In this way, a contact validation output is generated from which faults such as contact short circuits can be detected by the remote meter reading apparatus.

6 Claims, 10 Drawing Sheets

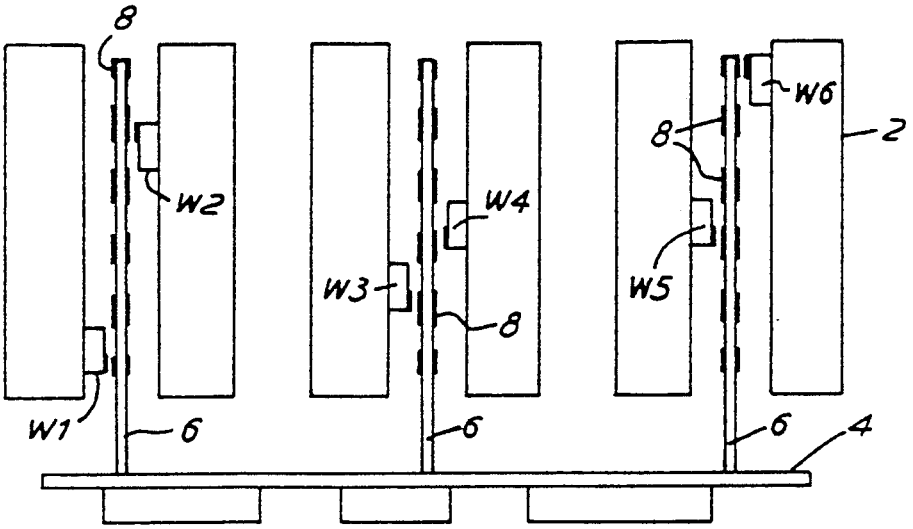
FIG. 2
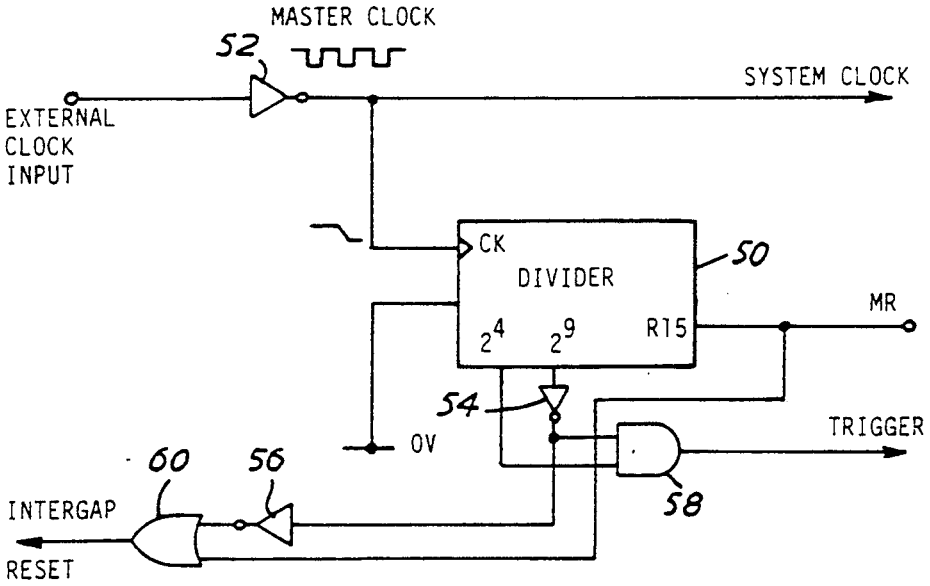
CLOCK GENERATOR FIG. 3

WIPER LINK DRIVER

SERIALIZER

SWITCH DECODING TRUTH TABLE

| DATA INPUTS | | | CONVERTOR | OUTPUT | |
|---|---|---|---|---|---|
| AAAAAAAAAA | * BB | P Q | IC7 BIT INPUT | SERIAL DATA | |
| 0123456789 | 01 | - | 6543210 | ASCII | CHR |
| XXXXXXXXXL | HH | X | HLLLHHL | 39 | 9 |
| XXXXXXXXLH | HH | X | HLLLHHH | 38 | 8 |
| XXXXXXXLHH | HH | X | HLLHLLL | 37 | 7 |
| XXXXXXLHHH | HH | X | HLLHLLH | 36 | 6 |
| XXXXXLHHHH | HH | X | HLLHLHL | 35 | 5 |
| XXXXLHHHHH | HH | X | HLLHLHH | 34 | 4 |
| XXXLHHHHHH | HH | X | HLLHHLL | 33 | 3 |
| XXLHHHHHHH | HH | X | HLLHHLH | 32 | 2 |
| XLHHHHHHHH | HH | X | HLLHHHL | 31 | 1 |
| LHHHHHHHHH | HH | X | HLLHHHH | 30 | 0 |
| HHHHHHHHHH | HH | X | HLLLLLL | 3F | ? |
| XXXXXXXXXX | LH | L | LHHLHLL | 4B | K |
| XXXXXXXXXX | HL | L | HHHLLHL | 0D | CR |
| XXXXXXXXXX | LH | H | LHHLLHL | 4D | M |
| XXXXXXXXXX | HL | H | HHHLLHL | 0D | CR |
| ---------- | LL | - | ------- | - | - |

NOTES: *.....LL CASE CAN'T OCCUR
L.....LOW VOLTAGE
H.....HIGH VOLTAGE
X.....DON'T CARE
CR.....ASCII CARRIAGE RETURN CODE
CHR....PRINTED CHARACTER EQUIVALENT
CONVERTOR....PARALLEL TO SERIAL CONVERSION

DECODING OF THE INPUT USES NEGATIVE LOGIC

FIG. 10

METERING APPARATUS

This invention relates to metering apparatus and in the most important example to apparatus for metering usage of public utilities such as gas and water.

There have been many proposals made for utility metering apparatus which provides not only a visual representation of meter output but also an encoded electrical output which can be "read" by interrogation over a suitable communications link or through the use of portable meter reading apparatus. Conventional metering apparatus empolys a bank of number wheels driven to represent the meter output and attention has been focused on adapting such apparatus to provide an encoded output.

In certain prior proposals, a wiper contact on each number wheel makes contact successively with an array of position contacts. By applying appropriate electrical signals to the wiper contacts and monitoring the signals appearing on the position contacts, it is possible to provide an electrical output representative of the number wheel positions. It will be apparent that utility metering apparatus is required to operate substantially continuously without maintenance over extremely long periods of time. Because of wear or corrosion, mechanical faults may occasionally arise in the contact structures. Such faults will not necessarily prevent operation of the apparatus but will often result in erroneous electrical indications of the meter reading. Thus, for example, spreading of contacts through wear, or the deposition of conducting material between contacts, can lead to short circuiting of two or more adjacent position contacts. Such short circuiting can lead to significant errors in the meter reading. Whilst the likelihood of a fault arising on any particular meter is small, the potentially large number of meters to be included in a utility billing system and the significance of any error in the amount billed for utility usage, means that this problem demands careful attention.

It is an object of this invention to provide improved metering apparatus having provision for detection of such faults as outlined above.

Accordingly, the present invention consists in metering apparatus comprising a metering device having an output; a plurality of indicator elements driven in response to the meter output such that the orientation of the respective indicator elements is indicative of the meter output; for each indicator element an array of position contacts, corresponding position contacts from each said array being connected with a corresponding one of a plurality of position terminals, and a wiper contact disposed to make contact successively with the position contacts of the array on driving of the corresponding indicator element; generator means for applying, in a measurement mode, measurement signals in sequence to the wiper contacts and for applying, in a test mode alternating with the measurement mode, test signals in sequence to the position terminals; encoder means connected with the position terminals and adapted to provide an encoded output representative of the signals on said position terminals; and data output means arranged to receive said encoded output and adapted, in synchronism with operation of the generator means, to provide a data output, said data representing in the measurement mode the position of the respective indicator elements and, in the test mode, a test output in which departure from a predetermined value is representative of short circuiting of two or more position contacts.

The invention will now be described by way of example with reference to the accompanying drawings in which:

FIG. 2 is a somewhat diagramatic section through mechanical parts of metering apparatus according to this invention;

FIGS. 3 to 8 are more detailed circuit diagrams of respective parts of the circuits shown in block form in FIG. 1;

FIG. 10 is a logic truth table illustrating the operating of the circuitry shown in FIG. 1;

Figure 1:
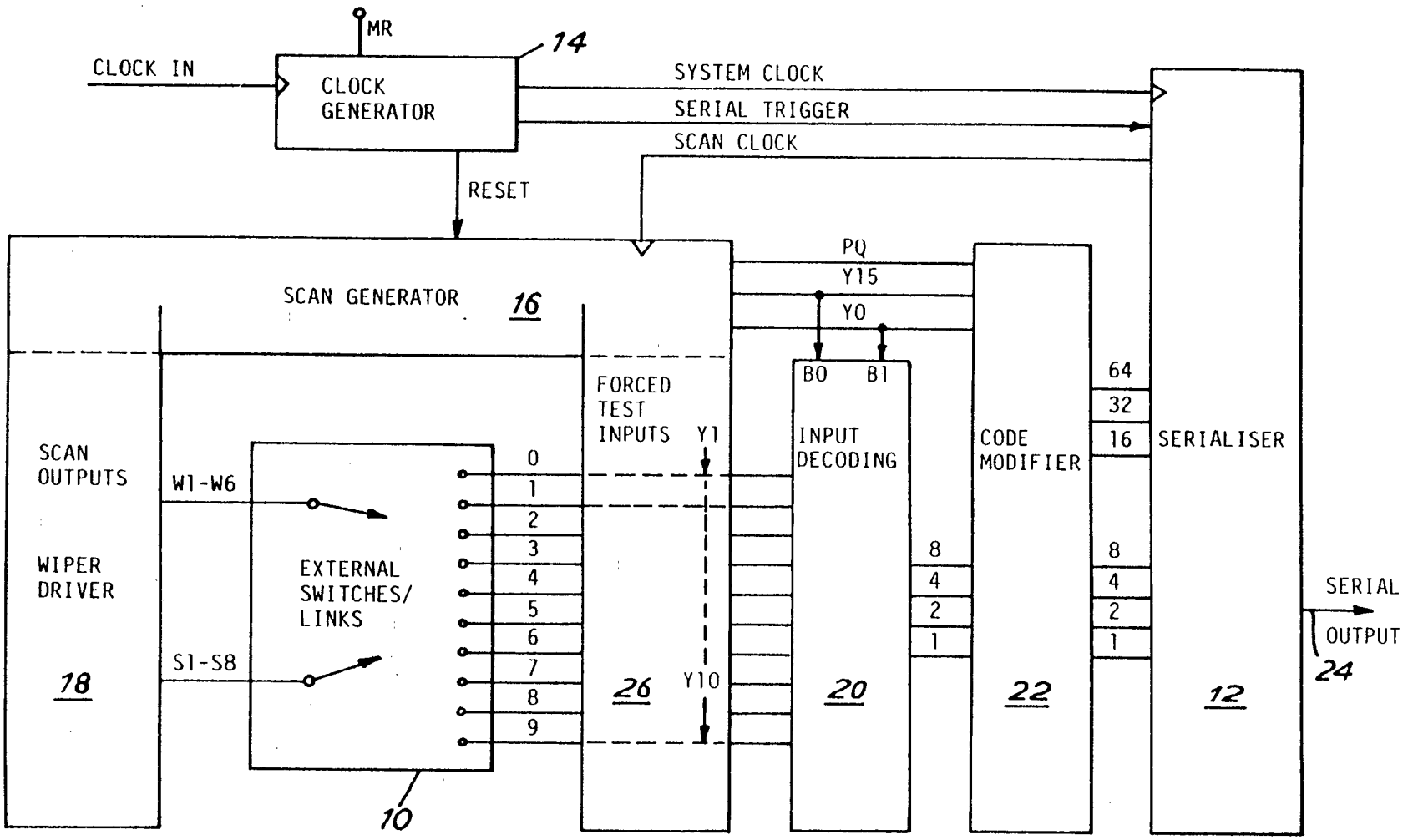
FIG. 1 is a block diagram illustrating electronic circuitry forming part of metering apparatus according to this invention.

Referring initially to FIG. 1, block 1 schematically represents a number wheel contact array and a series of serial number links. For the plurality of indicator elements in this example, a bank of six number wheels is assumed with, as shown in FIG. 2, each number wheel 2 having a wiper contact (W1 to W6). A main circuit board 4 carries three contact boards 6 which are interposed between corresponding pairs of number wheels. Each contact board carries on both sides an array of ten circumferentially disposed position contacts 8. It will be understood that as each number wheel rotates, the corresponding wiper contact establishes electrical connection successively with the position contacts on the opposing circuit board face. Corresponding position contacts from each array are connected together through tracks on the circuit boards and communicate with a corresponding one of ten position terminals (D0 to D9). Thus, for example, all six position contacts corresponding with position "0" of the corresponding number wheel are connected together and communicate with position terminal D0.

The metering apparatus additionally comprises eight serial contacts (S1 to S8) which (in a manner not apparent from FIG. 2) are connected through fixed links to a particular one of the position terminals D0 to D9. These links are set at the time of assembly of the metering apparatus and enable the definition of a unique serial number for each product. It will be understood that the main circuit board 14 additionally carries the integrated circuits and other components embodying the electronic circuitry of FIG. 1.

It may be helpful to outline the operation of the circuitry shown in FIG. 1 before the various circuitry elements are described in detail. Thus, in response to SCAN CLOCK signals provided by a serialiser unit 12 driven from a clock generator 14, a scan generator 16 causes, through wiper drive 18, a logical LOW signal to be applied in a pre set sequence to the six wiper contacts W1 to W6 and the eight serial number contacts S1 to S8. An encoder which comprises an input decoding unit 20 and a code modifier unit 22, monitors the signals appearing upon the position terminals D0 to D9 at each point in this sequence and provides an encoded signal in parallel form to the serialiser 12. This parallel input is scanned in synchronism with the application of logic signals to the wiper and serial number contacts and a serial ASCII output is produced at output terminal 24. This ASCII output includes six characters representing the positions of the six number wheels and eight characters representing the unique serial number. A forced input unit 26 interposed between the position terminals D0 to D9 and the input decoding unit 20 is operative during validation modes - which alternate with these measurement modes - to provide validation of the electrical contact integrity.

The apparatus according to this invention will now be described in more detail with reference to FIG. 1 and, in turn, to FIGS. 3 to 9. It will also be helpful to refer at times to the timing diagram which is FIG. 9 and the logic truth table which is FIG. 10.

Referring to FIG. 3, the clock generator 14 comprises a divider 50 (4040), inverters 52, 54 and 56; AND gate 58 and OR gate 60. The external clock input at 1,200 pulses per second is supplied through inverter 52 to the clock input of divider 50 and also to a SYSTEM CLOCK LINE which is connected with the serialiser 12. The $2^4$ output of the divider is AND'ed in gate 58 with the $2^9$ output inverted in inverter 54, to produce a TRIGGER output which comprises sixteen trigger pulses, each corresponding with sixteen SYSTEM CLOCK pulses, followed by a gap equivalent in time to sixteen trigger pulses. Referring to the timing diagram which is FIG. 9, line a) illustrates the TRIGGER output with line d) illustrating—to a considerably enlarged scale—one period of the TRIGGER output. The remaining lines of FIG. 9 correspond to the time scale of line d); thus line b) shows the sixteen SYSTEM CLOCK pulses occuring within a single trigger output period. The $2^9$ output of divider 50, through inverters 54 and 56, is OR'ed in gate 60 with a manual reset (MR) input which is connected additionally with the divider 50 and with the serialiser unit 12.

Figure 8:
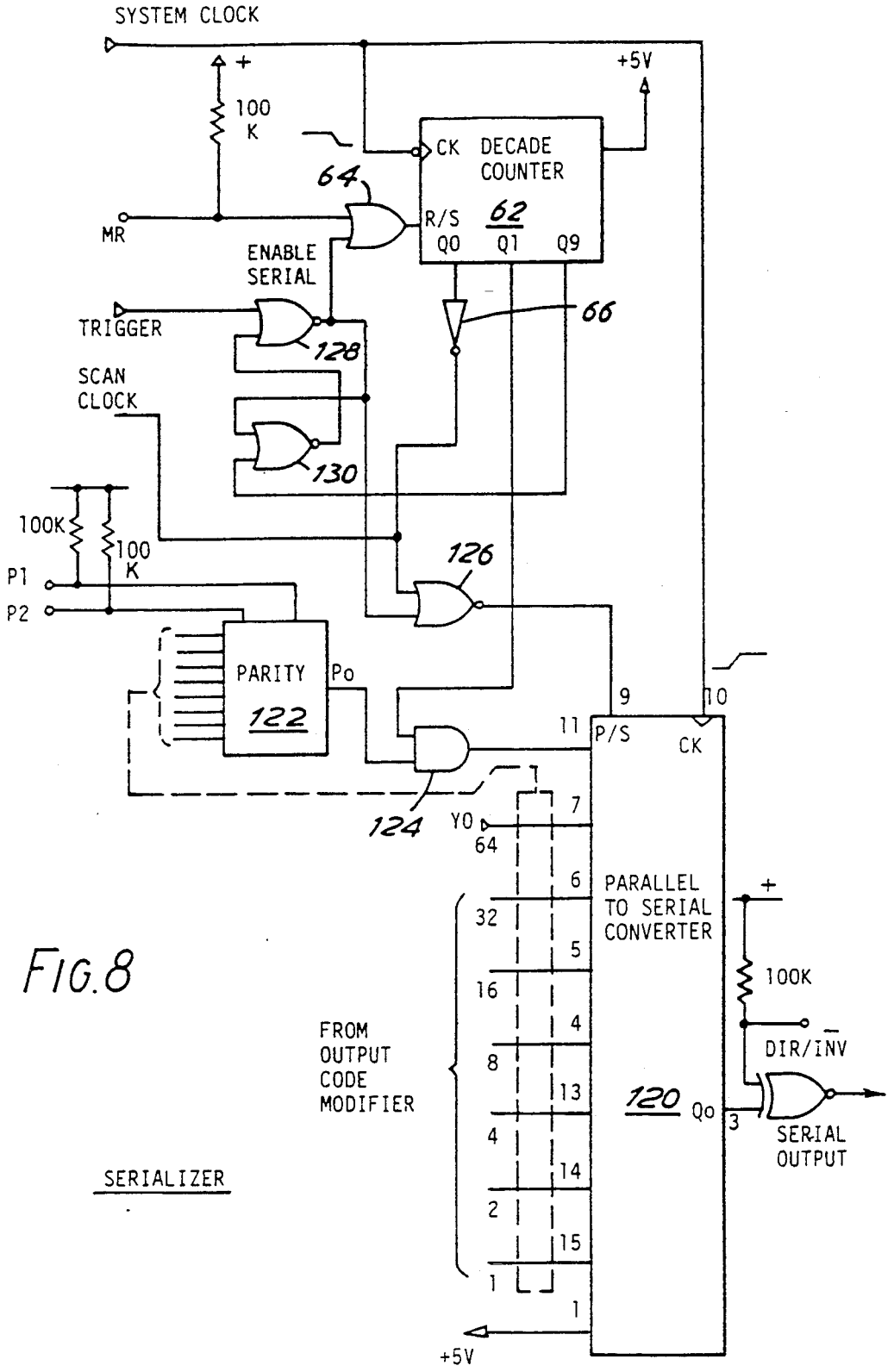
Figure 9:
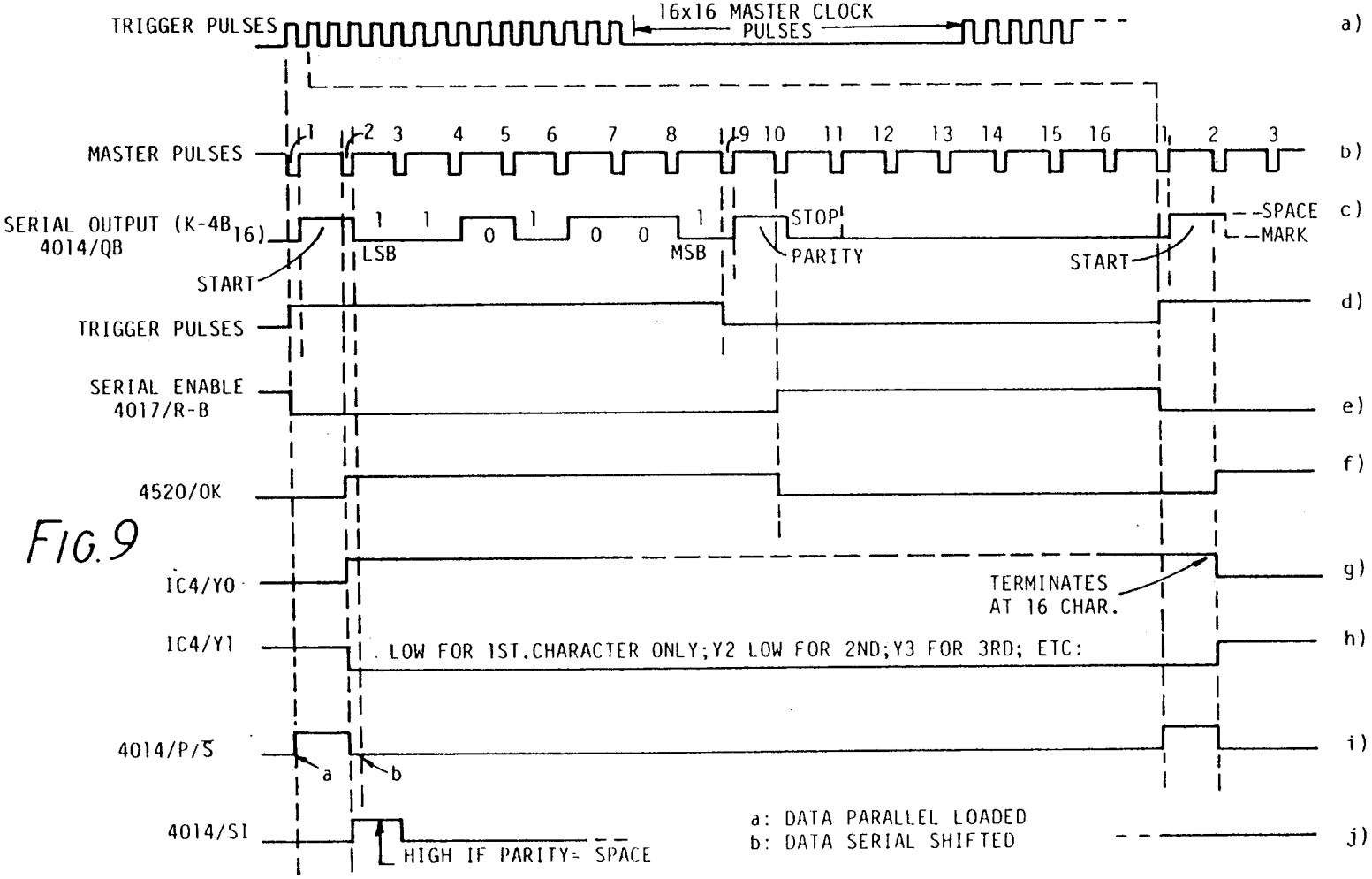
FIG. 9 is a timing diagram illustrating the operation of the circuitry shown in FIG. 1.

Referring now in part to FIG. 8, the serialiser unit 12 comprises a decade counter 62 (4017) which receives as a clock input the SYSTEM CLOCK line. The decade counter 62 additionally receives the MR line through OR gate 64. Of the ten output lines of counter 62, only lines Q0, Q1 and Q9 are utilised. Line Q0 serves through inverter 66 to produce a SCAN CLOCK signal which is illustrated at line f) of the FIG. 9 timing diagram.

Figure 4:
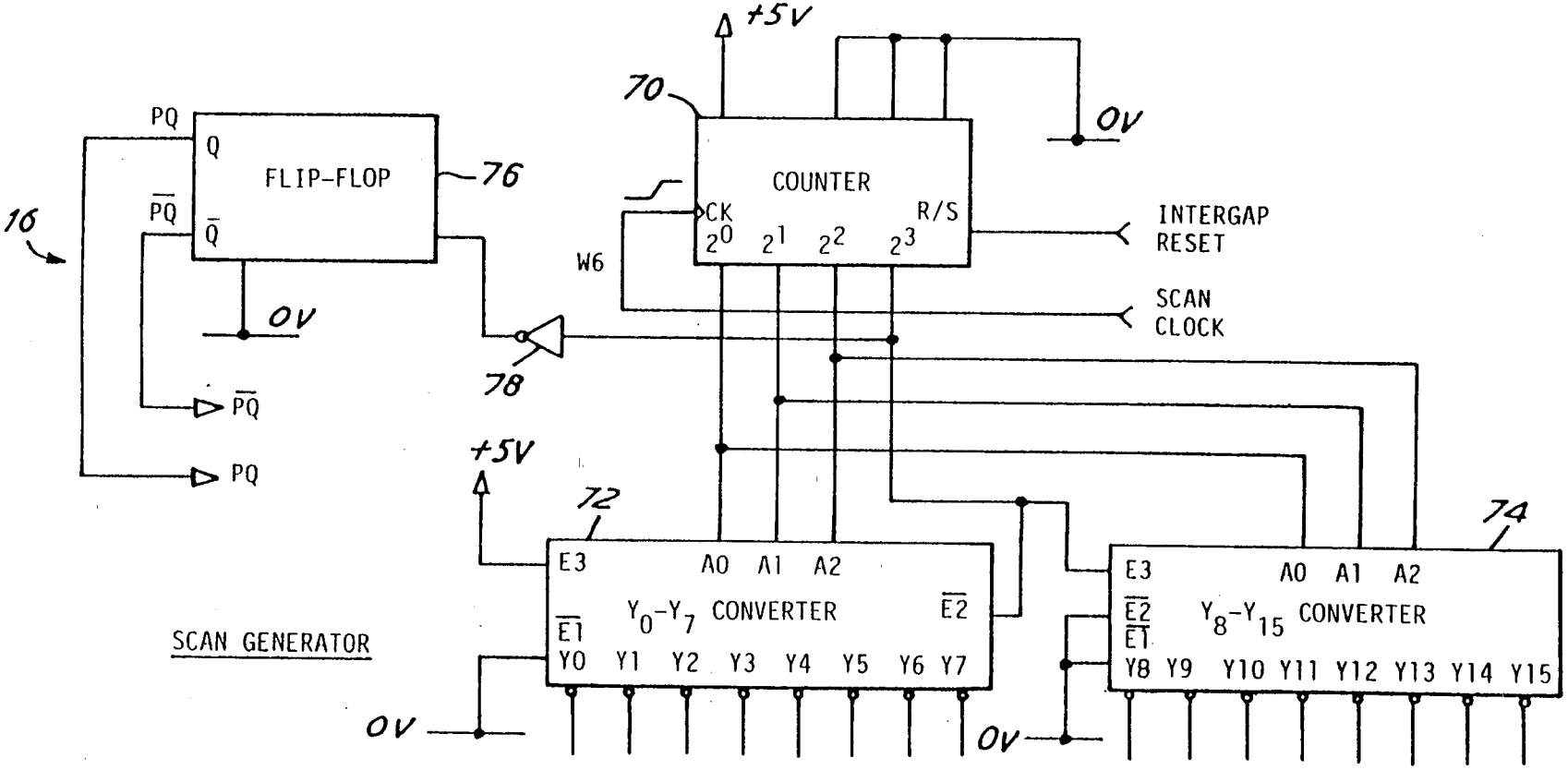

Referring now to FIG. 4, the scan generator 16 receives the SCAN CLOCK line as the clock input to a counter 70 (4520). Counter 70 provides a binary output on lines $2^0$, $2^1$, $2^2$ and $2^3$ which are connected to corresponding inputs of two three to eight line converters 72 and 74 (HC 138). Enabled alternately by the $2^3$ output of counter 70, these two converters (as will well be understood by those skilled in the art) operate as a four to sixteen line converter of the counter output. The sixteen output lines are labelled Y0 to Y15. Thus, as the SCAN CLOCK pulses are received, the output lines Y0 to Y15 are activated in succession. Negative logic is employed, and activation comprises the pulling LOW of the corresponding scan generator output Y0 to Y15. The scan generator 16 additionally comprises a flip flop 76 driven by the $2^3$ output of counter 70 through inverter 78. The flip flop 76 provides PQ and $\overline{PQ}$ outputs.

At reset, scan generator Y0 is LOW and all other generator outputs are HIGH. The PQ flag is LOW. On receipt of the first sixteen SCAN CLOCK pulses, the generator outputs are pulled LOW in sequence. At the beginning of a second series of sixteen pulses, the PQ flag goes HIGH and the scan generator outputs Y0 to Y15 are again pulled LOW in sequence. The first sixteen pulses, with PQ=LOW, represent a normal measurement cycle or mode. The second sequence of sixteen pulses with PQ=HIGH represents a mechanics validation cycle as will be described in more detail below.

Figure 5:
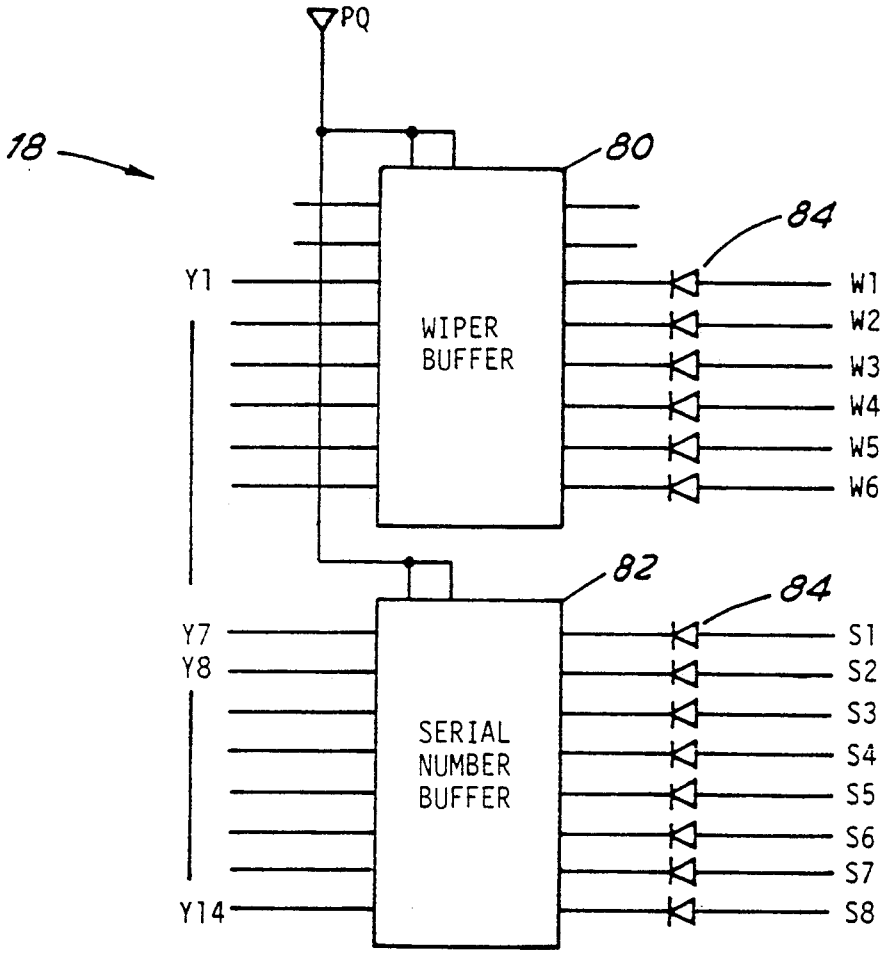

Referring now to FIG. 5, the wiper driver 18 comprises two octal buffers 80 and 82 (HC 244) which both receive the PQ line as an enabling input and receive between them the scan generator outputs Y1 to Y14. Scan generator outputs Y0 and Y15 are not required in the scanning of six wiper contacts and eight serial number links and are used, as we will describe, to generate fixed ASCII character identifiers. The buffers 80 and 82 provide an open drain output transistor for each of the six wiper contacts W1 to W6 and eight serial number links S1 to S8. In the measurement mode, with PQ=LOW, the buffers are enabled and the output transistors are turned ON in sequence. Thus a LOW signal of scan generator output Y1, for example, will result in wiper contact W1 being pulled LOW. In the mechanics validation cycle, with PQ=HIGH, the buffers are disabled and all output transistors are turned off. All the buffer outputs are therefore high impedance and the wiper contacts and the serial number links are effectively permitted to float. A diode 84 is provided on each output line of the buffers 80 and 82 so as to prevent interaction between adjacent lines.

Figure 6:
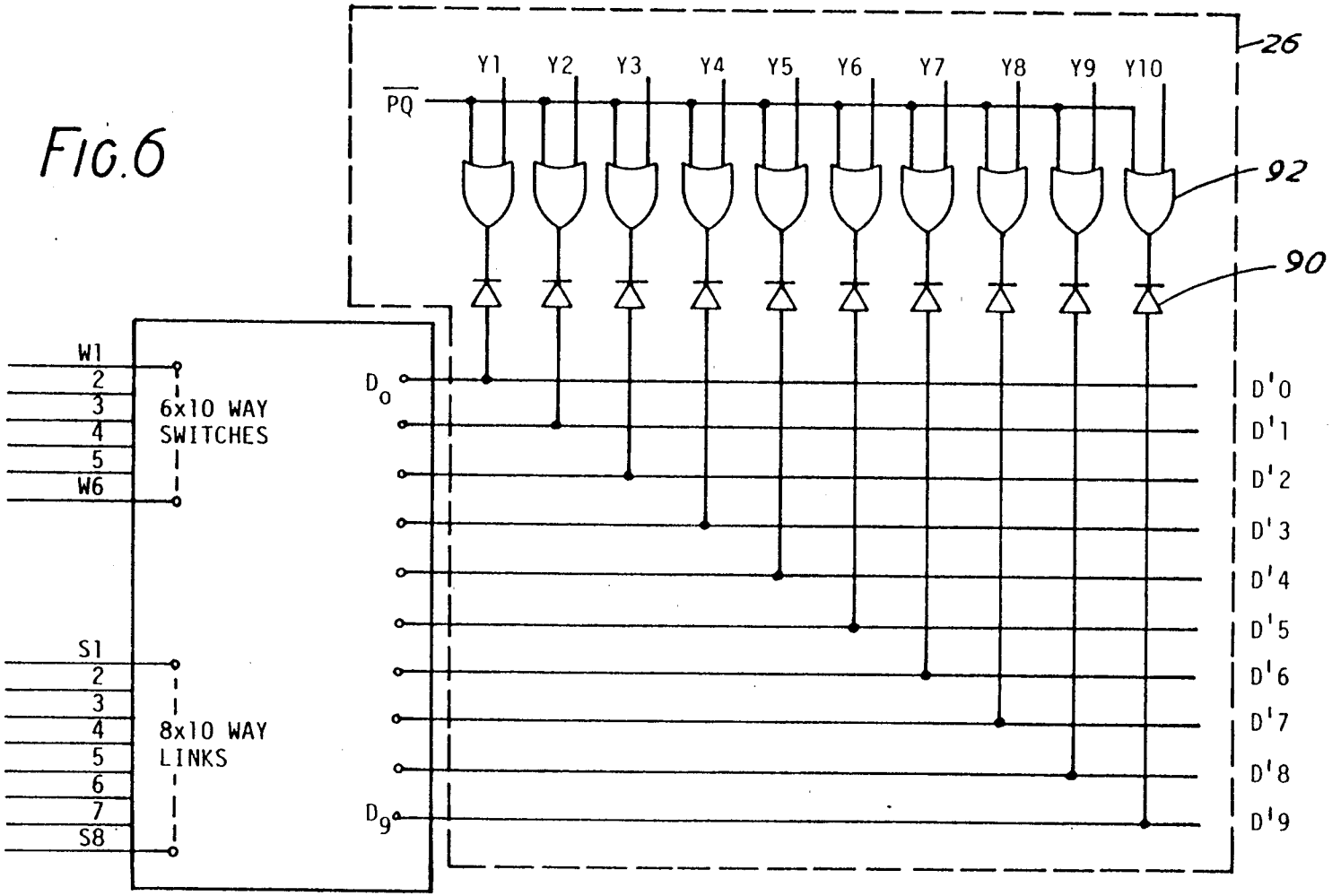

Turning now to FIG. 6, the position terminals D0 to D9 are connected respectively with inputs D'0 to D'9 of the input decoding unit 20. Each of these connecting lines is additionally connected through a diode 90 with one of a series of OR gates 92. Each OR gate 92 receives as one input the $\overline{PQ}$ signal and as the other input the corresponding one of the scan generator outputs Y1 to Y10.

In the measurement mode, PQ=LOW and the output of each OR gate 92 is consequently high. The diodes 90 then effectively isolate the OR gates 92 from the connecting lines between position terminals D0 to D9 and the input decoding unit 20. In the mechanics validation mode, PQ=HIGH and, as has been described, the position terminals D0 to D9 "see" a high impedence through the wiper contacts and serial number links. The outputs of the OR gates 92 are controlled by the scan generator outputs Y1 to Y10 so that the inputs D'0 to D'9 of the input decoding 20 are pulled LOW in sequence. During this mode, inputs to the decoding unit 20 thus correspond with inputs representing number wheel positions 0-9, successively.

It will be understood that in a fault condition where two adjacent position terminals D0 to D9 are short circuited, this sequence 0-9 will be disrupted since the step of pulling down one of the short circuited position terminals will clearly also pull down the adjacent position terminal. The manner in which a departure from the expected sequence is detected, will be described later.

Figure 7:
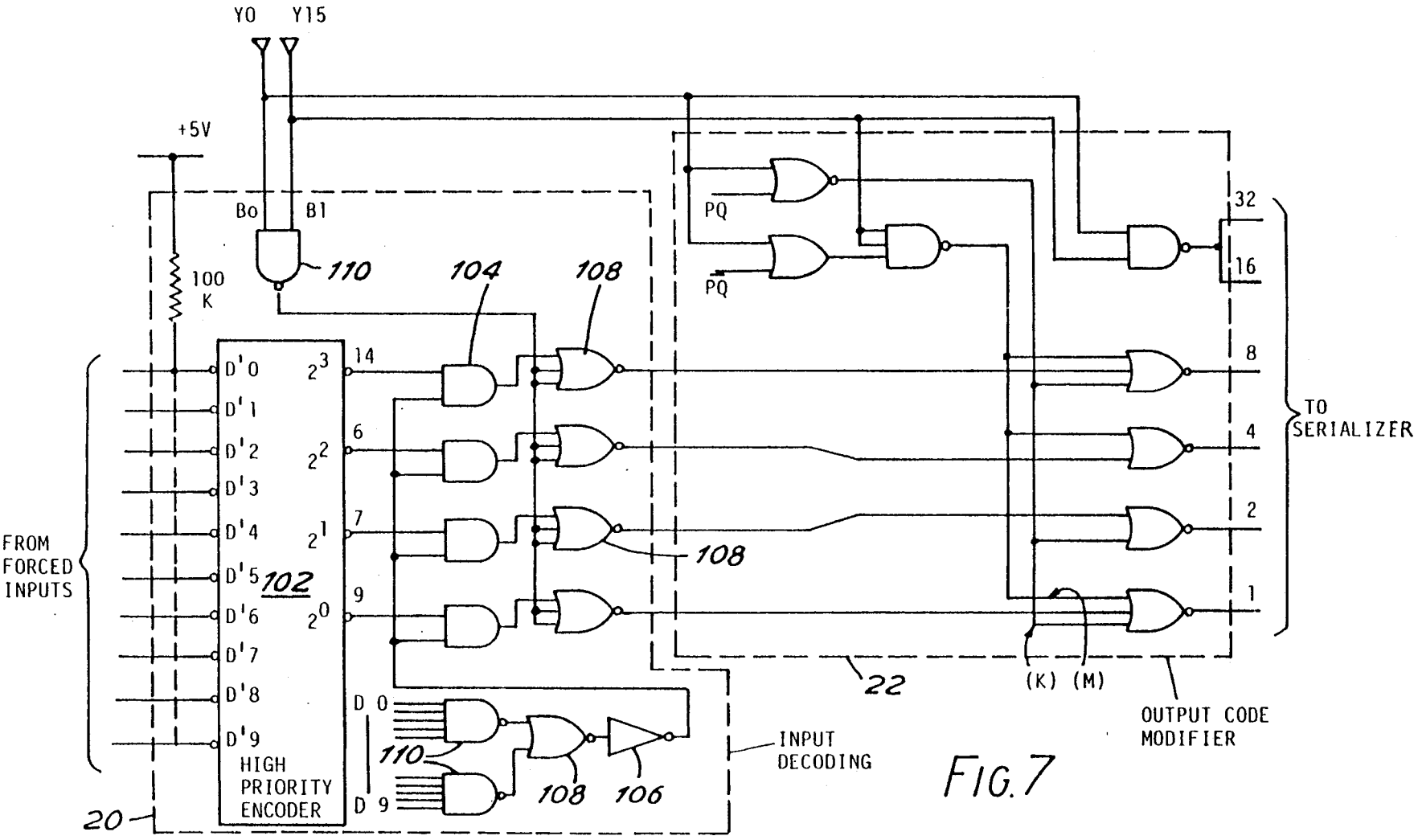

Turning now to FIG. 7, the code modifier unit 20 comprises a high priority encoder 102 (HC147). This has $2^0$, $2^1$, $2^2$ and $2^3$ outputs which provide a binary indication of, in the measurement mode, the position or value of the number wheel or serial link currently being scanned and, in the mechanics validation mode, an effective numerical value created by the forced inputs. The outputs from encoder 102 are connected with respective AND gates 104, second inputs of which are connected with an inverter 106. This is connected in turn with the output of a NOR gate 108 receiving the outputs of two NAND gates 110. These NAND gates receive as inputs the same signals applied to inputs D'0 to D'9 of the encoder 102. The function of the gates 106, 108 and 110 is to detect the "all contacts open-circuit" condition and, through AND gates 104, effectively disable the encoder in those circumstances. The outputs of the AND gates are connected with the inputs of respective NOR gates 108, with the other inputs of each NOR gate being connected to the output of a NAND gate 110 receiving Y0 and Y15 as inputs. Thus, if Y0 and Y15 are both HIGH (which will be the case during scanning of the six wiper contacts and eight serial number links as lines Y1 to Y14 are successively pulled LOW). The input decoding unit 20 will provide a binary coded decimal output to the code modifier unit 22. If either of Y0 or Y15 is LOW, the outputs of NOR gates 108 are pulled LOW, effectively disabling the input decoder.

The manner of operation of the input decoder unit 20 may be further clarified by study of the truth table which appears as FIG. 10. In that truth table the conventional notation is adopted with H=HIGH; L=LOW and X="irrelevant".

The code modifier unit 22 is also shown in FIG. 7. It receives the parallel output lines from the input decoding unit 20 together with Y0, Y15, PQ and PQ. The code modifier unit 22 provides an output on six parallel lines to the serialiser 12. Referring both to FIG. 7 and the truth table which is FIG. 10, it will be apparent that if both Y0 and Y15 are HIGH (that is to say during scanning of the wiper contacts and serial number links), the output from the input decoder is passed directly to the serialising unit 12 and appears as an ASCII numerical character 0 to 9. The code modifier serves the purpose of inserting code for an appropriate ASCII character at the beginning and end of each sixteen pulse sequence. Thus if Y0=PQ=LOW (representing the commencement of a first sequence of sixteen pulses) then code for the ASCII character "K" is passed to the serialiser unit. If Y0=LOW and PQ=HIGH (representing the first pulse in a second series of sixteen pulses), then code for the ASCII character "M" is produced. If Y15=LOW, the code for the ASCII character CR or "return" is forced irrespective of the state of PQ, that is to say at the end of both the first and second sixteen pulse sequences. If all wiper contacts are open circuit (as deleted by the NAND gates 110) the ASCII character "?" is generated.

Referring now to FIG. 8, the serialiser 12 comprises an eight bit parallel to serial converter 120 (4014). This receives as inputs the six output lines from the code modifier unit 22, the line Y0 and a parity line generated in parity generator 122 and gated by AND gate 124. As illustrated schematically in FIG. 8, the parity generator 122 receives the other inputs to the parallel to serial converter. AND gate 124 additionally receives line Q1 from decade counter 62. The converter 120 further receives as a clock input the SYSTEM CLOCK line and as a parallel/serial load flag the output of the NOR gate 126. The inputs to this NOR gate 126 are, respectively, the SCAN CLOCK line and the output of a latch formed by paired NOR gates 128 and 130 receiving as respective inputs the TRIGGER line and output Q9 from the decade counter 62.

The manner of operation of the serialiser 12 can now be understood.

At reset, output Q0 is HIGH so that converter 120 is in a parallel load mode and eight bits are loaded. These comprise a start bit (corresponding to the permanently high connection of the first input terminal to the converter 120). Six "derived" data bits from the code modify unit 22 and a seventh data bit which is effectively Y0. Generation of the 7th data bit can be simplified in this manner as can be verified by inspection of the truth table. As Q0 goes LOW (refer to FIG. 9*i*), the converter is switched to serial load so that, whilst Q1 is LOW, parity data is clocked in (see FIG. 9*j*). As the serial data continues to clock out, gate 124 effectively isolates the partiy generator so that zeros are clocked in, in series. The first of these zeros is technically a stop bit. The serial output is illustrated at FIG. 9*c*).

It will be understood that the ASCII output from the serialiser will in the case of normal operation take the form:

$KN^1N^2N^3N^4N^5N^6S^1S^2S^3S^4S^5S^6S^7S^8$[CR]
MO123456789????[CR]

Where $N^1$ to $N^6$ represent numeric characters indicating the position of the six number wheels and, similarly, $S^1$ to $S^8$ are numeric characters providing the unique serial number. The characters 0 to 9 in the second pulse sequence arise directly from the input forcing of the test or mechanics validation mode. The question mark characters represent an open circuit condition on all contacts.

In the case of a mechanical fault leading, for example, to a short circuit between position contacts four and five on one of the number wheels, the scan signal Y4 will, in the forced input operation of the test mode, cause a LOW to appear not only on input D'4 of the input decoding unit 20, but also on input D'5, via the mechanical short circuit. Since the input decoder operates on higher value expected "4". In this case, the 16 character ASCII in the test mode would be:

M0123556789????[CR].

This departure from the predetermined sequence can readily be identified as an error.

Figure 11:
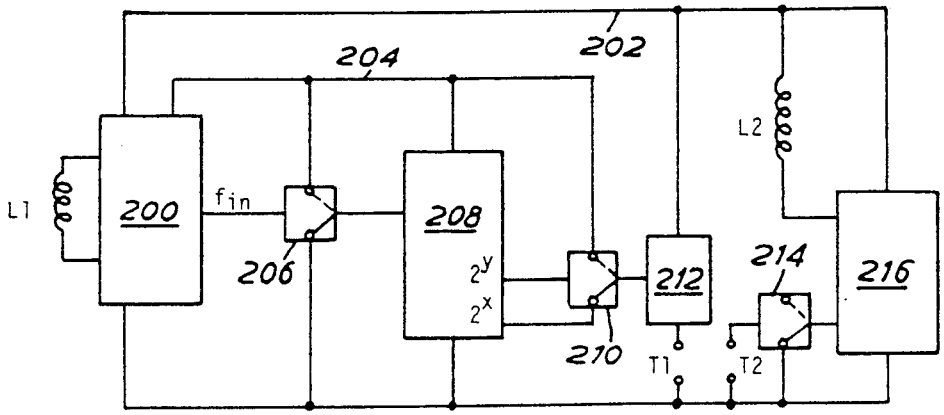
FIG. 11 is a block diagram illustrating an interface for connection with the circuitry of FIG. 1; and, FIG. 12 is a circuit diagram, partly in block form, illustrating the inter-relationship between the elements shown in FIGS. 1 and 11.

Turning now to FIG. 11, there is shown diagramatically an interface for use with the encoding circuitry described above. The function of this interface is to take power from a portable reading device held in proximity to the interface and to transmit data to the device on demand. The interface includes power and data coils L1 and L2 respectively. These are mounted at a suitable location to enable a probe or other part of the reading unit to be positioned with corresponding coils in the probe being inductively linked with the coils L1 and L2 as shown schematically in the drawing.

Coil L1 feeds a power supply unit 200 which in generally conventional manner is provided with a rectifying bridge network, smoothing capacitors and voltage protection Zener diodes. The power supply unit 200 has a rectified but unregulated output on line 202; a rectified and regulated output on line 204 and an alternating output $f_{in}$. This alternating output is applied as a clock input to a multiplexer 206 which has an output switched at the frequency $f_{in}$ between the regulated supply rail 204 and ground. The output of multiplexer 206 is connected to a binary divider 208. Output line $2^x$ of the divider is connected as a clock input to a further multiplexer 210 which has inputs connected respectively with output $2^y$ of divider 208 and the regulated supply rail 204. In this way the output of the multiplexer 210 is switched between the supply rail and the output $2^y$ at a frequency corresponding to the output $2^x$. By appropriate selection of the integers x and y an appropriate mark space ratio is created. The output of multiplexer 210 is connected with a driver stage 212 providing on terminal pair T1 both the clock input and power to the previously described encoder circuitry.

The output from the serialiser 12 is connected on terminal paid T2 as the clock input to a further multiplexer 214 having inputs which are respectively connected to the ground rail and permitted to float. This multiplexer accordingly functions as an inhibitor. The output of multiplexer 214 is connected as the control input to a Colpitts oscillator 216 with the output data coil L2 being connected across the output of the oscillator and the unregulated supply rail. There accordingly appears across the output coil L2 a modulated signal representative of the ASCII output of the above described encoder.

Figure 12:
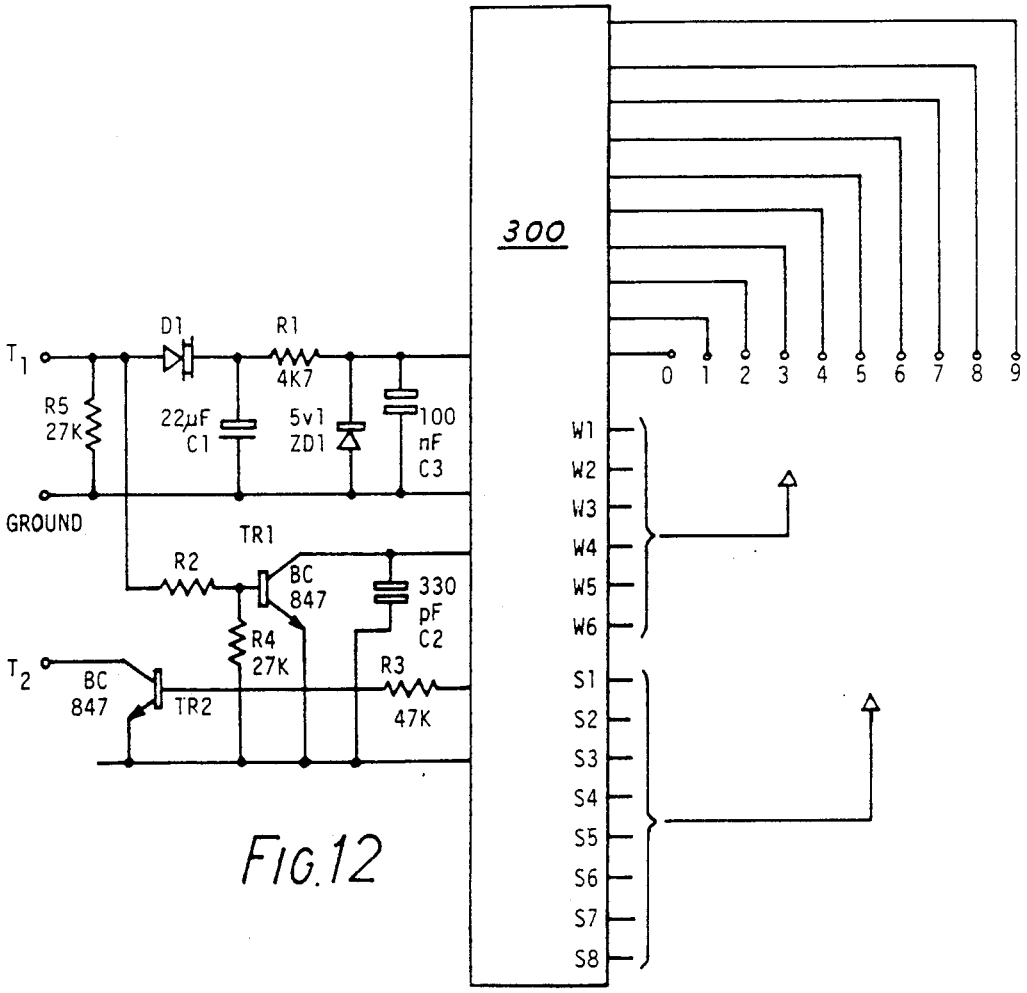

The manner of interconnection of the interface shown in FIG. 11 with the circuitry of FIG. 1, is more easily described with reference to FIG. 12. Here, the block 300 designates the circuit elements of FIG. 1 with the exception, of course, of the contacts and serial number links represented by block 10.

The combined power and clock input on terminal T1 is rectified and smoothed through diode D1 and capacitor C1. Voltage regulation is provided by resistance R1 and Zener diode ZD1, whilst capacitor C3 serves as noise suppression. Terminal T1 is further connected through resistance R2 to the base of npn transistor TR1, resistance R4 serving in turn to connect the base of TR1 with ground. The collector of TR1 serves to provide the CLOCK input with capacitor C2 again serving as noise suppression.

The SERIAL OUTPUT line is connected through resistance R3 with the base of npn transistor TR2, the collector of which is connected with terminal T2.

In a preferred form of this invention, the circuit elements comprised within block 300 are embodied in a single application specific integrated circuit.

It should be understood that this invention has been described by way of example only and a wide variety of modifications are possible without departing from the scope of the invention. Thus other arrangements of position indicated with wiper and position contacts will be possible, it merely being necessary that for each indicator element there is provided an array of position contacts and a wiper contact which successively makes contact with these position contacts as the indicator element is driven. The wiper contact may be the stationary element. The indicator elements may of course take a variety of forms other than the described coaxial number wheels. The use of fixed serial number links which are scanned along with the wiper contacts is believed to be advantageous but is not an essential feature of this invention.

It will be apparent to the skilled man that there are many ways other than the described circuitry for applying measurement signals in sequence to the wiper contacts and for applying, a test mode, test signals to the position terminals. Similarly, the input decoding unit could be replaced by a variety of other forms of encoder means, which need not necessarily include perform the additional function of the described code modifier unit.

The described interface could be replaced by alternative designs or by a permanent power supply and fixed data links. Still further interfaces could be provided for other methods of remote interrogation of the meter reading.

I claim:

1. Metering apparatus comprising a metering device having an output; a plurality of indicator elements driven in response to the meter output such that the orientation of the respective indicator elements is indicative of the meter output; for each indicator element an array of position contacts, corresponding position contacts from each said array being connected with a corresponding one of a plurality of position terminals, and a wiper contact disposed to make contact successively with the position contacts of the array on driving of the corresponding indicator element; generator means for applying, in a measurement mode, measurement signals in sequence to the wiper contacts and for applying, in a test mode alternating with the measurement mode, test signals in sequence to the position terminals; encoder means connected with the position terminals and adapted to provide an encoded output representative of the signals on said position terminals; and data output means arranged to receive said encoded output and adapted, in synchronism with operation of the generator means, to provide a data output, said data representing in the measurement mode the position of the respective indicator elements and, in the test mode, a test output in which departure from a predetermined value is representative of short circuiting of two or more position contacts.

2. Apparatus according to claim 1, wherein said generator means comprises scan generator means having a plurality of sequentially energized outputs connected respectively with said wiper contacts through buffer means, said buffer means being enabled during said measurement mode and disabled during said test mode.

3. Apparatus according to claim 2, wherein at least some of said scan generator outputs are connected through a forced input unit with the respective position terminals, said forced input unit disabling the connection of said scan generator outputs during said measurement mode and enabling the connection of said scan generator outputs during said test mode.

4. Apparatus according to claim 3, said generator means further comprising means for generating a binary test flag the states of which are indicative of respectively the test and measurement modes.

5. Apparatus according to claim 4, wherein said forced input unit is controlled by said test flag.

6. Apparatus according to claim 2, wherein the scan generator means comprises additional outputs energized sequentially with said outputs, the encoder means being connected to receive said additional outputs and to generate data marker characters therefrom.

* * * * *